US009893449B2

(12) United States Patent
Liang et al.

(10) Patent No.: US 9,893,449 B2
(45) Date of Patent: Feb. 13, 2018

(54) ELECTRICAL CONNECTOR

(71) Applicant: ALLTOP ELECTRONICS (SUZHOU) LTD., Taicang, JiangSu Province (CN)

(72) Inventors: Li-Li Liang, Taicang (CN); Ya-Juan Gou, Taicang (CN); Zhi-Qiang Rong, Taicang (CN); Mao-Jung Huang, Jhonghe (TW); Wang-I Yu, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 15/609,299

(22) Filed: May 31, 2017

(65) Prior Publication Data

US 2017/0352970 A1 Dec. 7, 2017

(30) Foreign Application Priority Data

Jun. 7, 2016 (CN) ..... 2016 1 0397755
Jun. 7, 2016 (CN) ..... 2016 2 0546556 U

(51) Int. Cl.

| | |
|---|---|
| ***H01R 13/504*** | (2006.01) |
| ***H01R 12/79*** | (2011.01) |
| ***H01R 13/502*** | (2006.01) |
| ***H01R 13/6581*** | (2011.01) |
| ***H01R 13/6598*** | (2011.01) |

(52) U.S. Cl.

CPC ..... *H01R 12/79* (2013.01); *H01R 13/502* (2013.01); *H01R 13/6581* (2013.01); *H01R 13/6598* (2013.01)

(58) Field of Classification Search

CPC ..... H01R 13/502; H01R 13/6581; H01R 13/6598

See application file for complete search history.

(56) References Cited

U.S. PATENT DOCUMENTS

| | | | | |
|---|---|---|---|---|
| 9,461,378 | B1 * | 10/2016 | Chen | H01R 12/707 |
| 2004/0092164 | A1 * | 5/2004 | Lee | H01R 13/5845 439/606 |
| 2004/0097132 | A1 * | 5/2004 | Cheng | H01R 13/405 439/606 |
| 2012/0302077 | A1 * | 11/2012 | Wu | H01R 13/5213 439/135 |
| 2013/0045642 | A1 * | 2/2013 | Wu | H01R 24/30 439/676 |

* cited by examiner

*Primary Examiner* — Briggitte R Hammond
(74) *Attorney, Agent, or Firm* — Sughrue Mion, PLLC

(57) ABSTRACT

An electrical connector includes an insulative housing and two contact modules. The insulative housing has a bottom mounting portion having a cavity opening downwardly and a mating portion, the mating portion has a central mating space and a pair of side walls on both sides of the mating space, and a plurality of contact receiving passageways defined on each side wall. Each contact module has an insulator received in the cavity and a plurality of contacts insert-molded in the insulator, each contact defines a contacting arm and a soldering portion. The insulative housing defines a pair of locating portions extending downwards from two sides of the mounting portion, the distance between the pair of locating portions is smaller than an internal diameter of the cavity, a pair of demising slots are formed on an interior side of each locating portion for the contact modules passing through.

20 Claims, 10 Drawing Sheets

ELECTRICAL CONNECTOR

BACKGROUND

1. Technical Field

The present disclosure relates to an electrical connector, and more particularly to an electrical connector can be assembled conveniently.

2. Description of Related Art

A wide range of electrical connectors in electronics are used for data transmission, data storage or image display, such as from the earlier conventional ATA (Advanced Technology Attachment) to SCSI (Small Computer System Interface), SATA (Serial Advanced Technology Attachment) and the more recently SAS interface (serial SCSI, Serial Attached SCSI). For many emerging applications with high speed data transmission, serial communication technology can solve the performance bottleneck problem of traditional parallel technology, serial attached SCSI (SAS) is the development of parallel SCSI based on serial technology, and has an advantage of higher signal transmission rate, and also compatible with SATA drive, in addition, SAS has a smaller profile than SCSI.

SAS connector mainly supports for high-speed serial signal transmission and power supply, and is generally adopted with enhanced design, that can be used in compact storage applications to achieve a higher reliability, as the overall size of the SAS connector is small, so contacts are not easy to be assembled into a housing of the SAS connector.

It is desirable to provide an improved electrical connector for solving above problems.

SUMMARY

In one aspect, the present invention includes an electrical connector. The electrical connector includes an insulative housing being elongated and two contact modules assembled into the insulative housing. The insulative housing has a bottom mounting portion and a mating portion extending upwards from the mounting portion, the mounting portion has a cavity opening downwardly, the mating portion has a central mating space extending along a lengthwise direction and a pair of side walls on both sides of the mating space, and a plurality of contact receiving passageways defined on each side wall and communicated with the cavity along a height direction. The contact modules assembled into the insulative housing from a lower side of the mounting portion along a down-to-up direction, and each contact module having an insulator received in the cavity and a plurality of contacts insert-molded in the insulator, each contact defining a contacting arm projecting upwards into the relative contact receiving passageway and a soldering portion extending downwards to be exposed out of the relative insulator. The insulative housing defines a pair of locating portions extending downwards from two sides of the mounting portion, the distance between the pair of locating portions is smaller than an internal diameter of the cavity along the lengthwise direction, and a pair of demising slots are formed on an interior side of each locating portion for the contact modules passing through.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
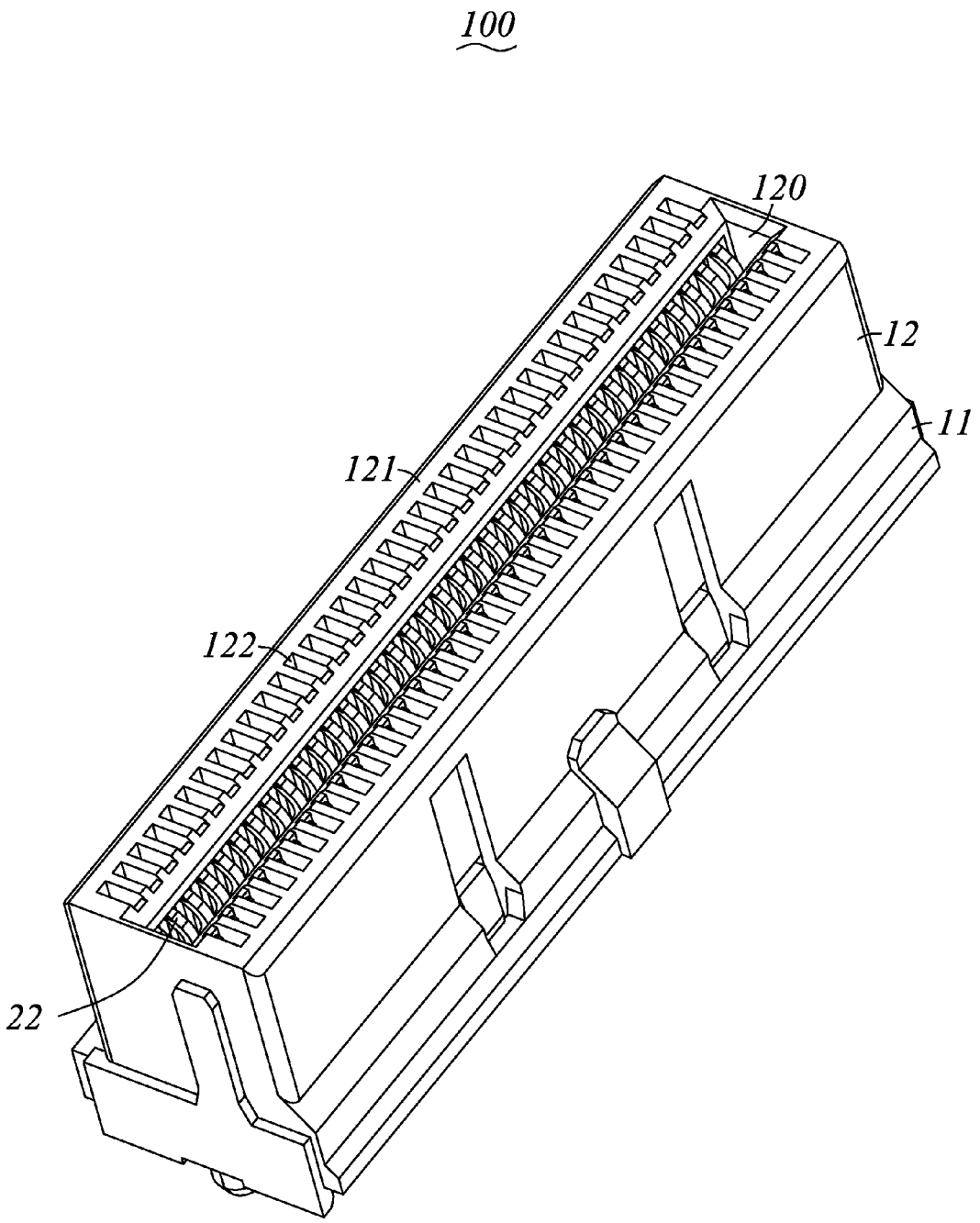
FIG. 1 is a perspective view of an electrical connector in accordance with an illustrated embodiment of the present disclosure.
Figure 2:
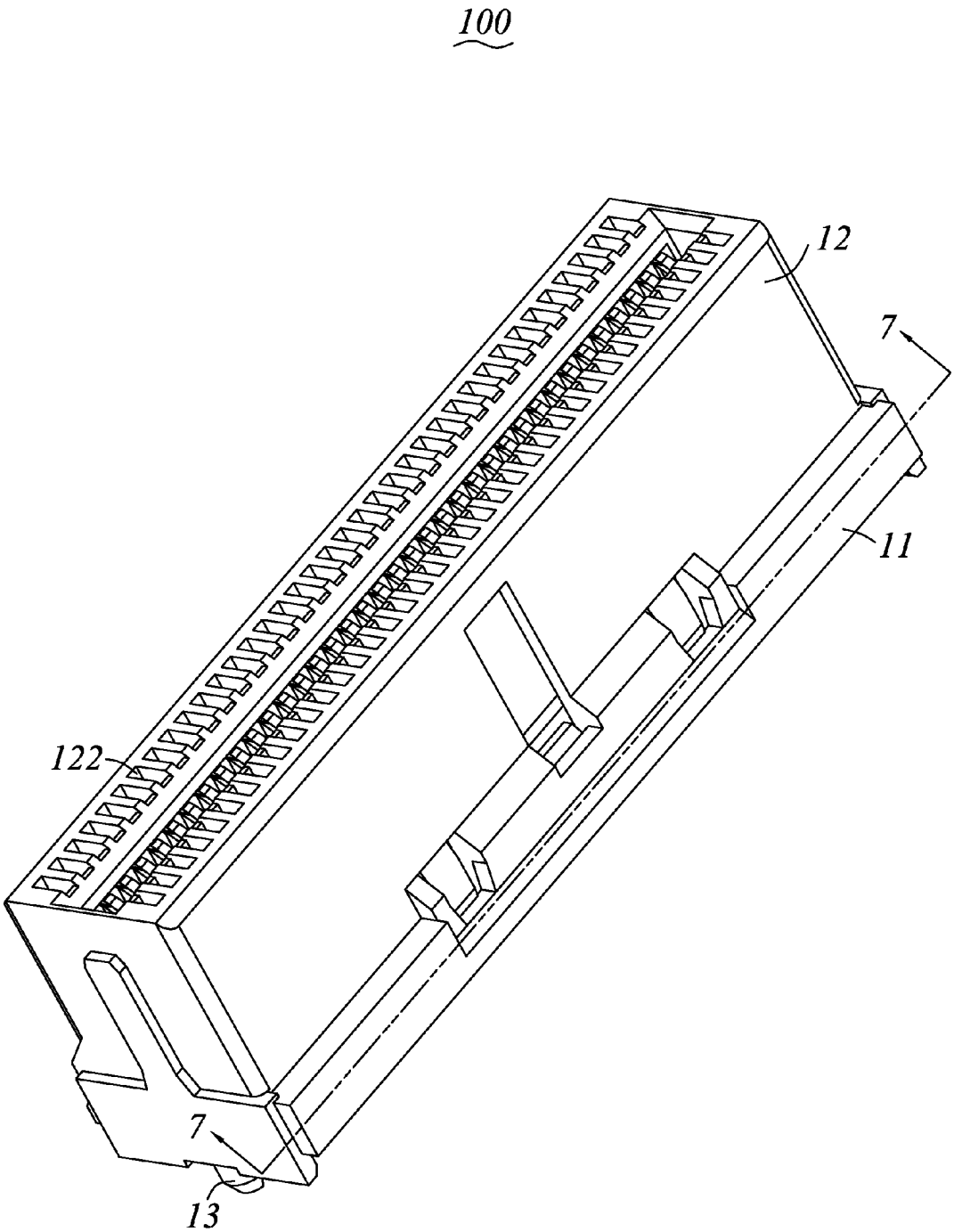
FIG. 2 is a view similar to FIG. 1, while viewed from another aspect.

Reference will now be made to the drawing figures to describe the embodiments of the present disclosure in detail. In the following description, the same drawing reference numerals are used for the same elements in different drawings.

Referring to FIGS. 1 to 7, an illustrated embodiment of the present disclosure discloses an electrical connector 100 is a SAS connector for mounting on a printed circuit board (not shown), and comprises an insulative housing 1 and two contact modules 2.

Figure 3:
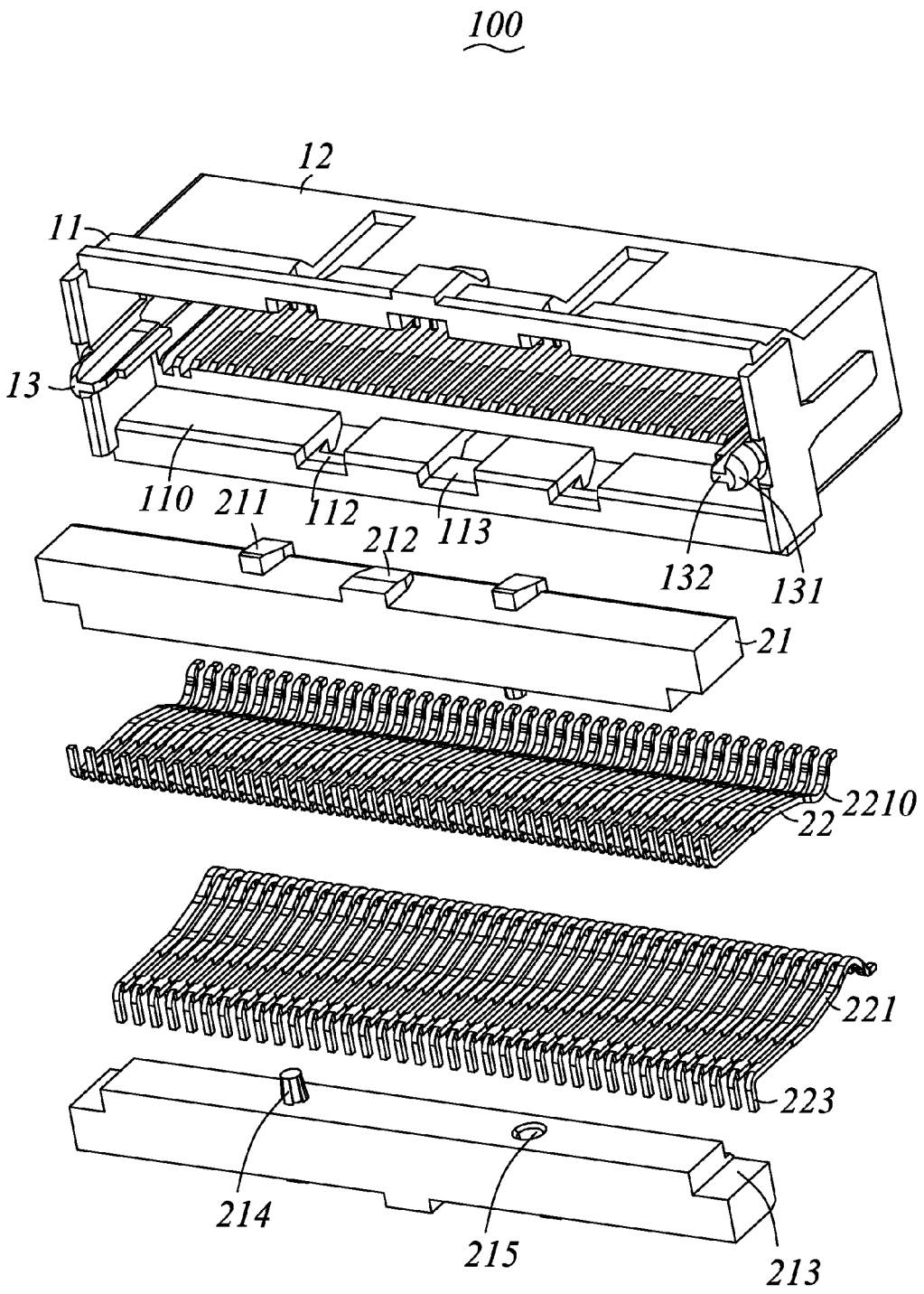
FIGS. 3-4 are exploded views of the electrical connector shown in FIG. 1.
Figure 4:
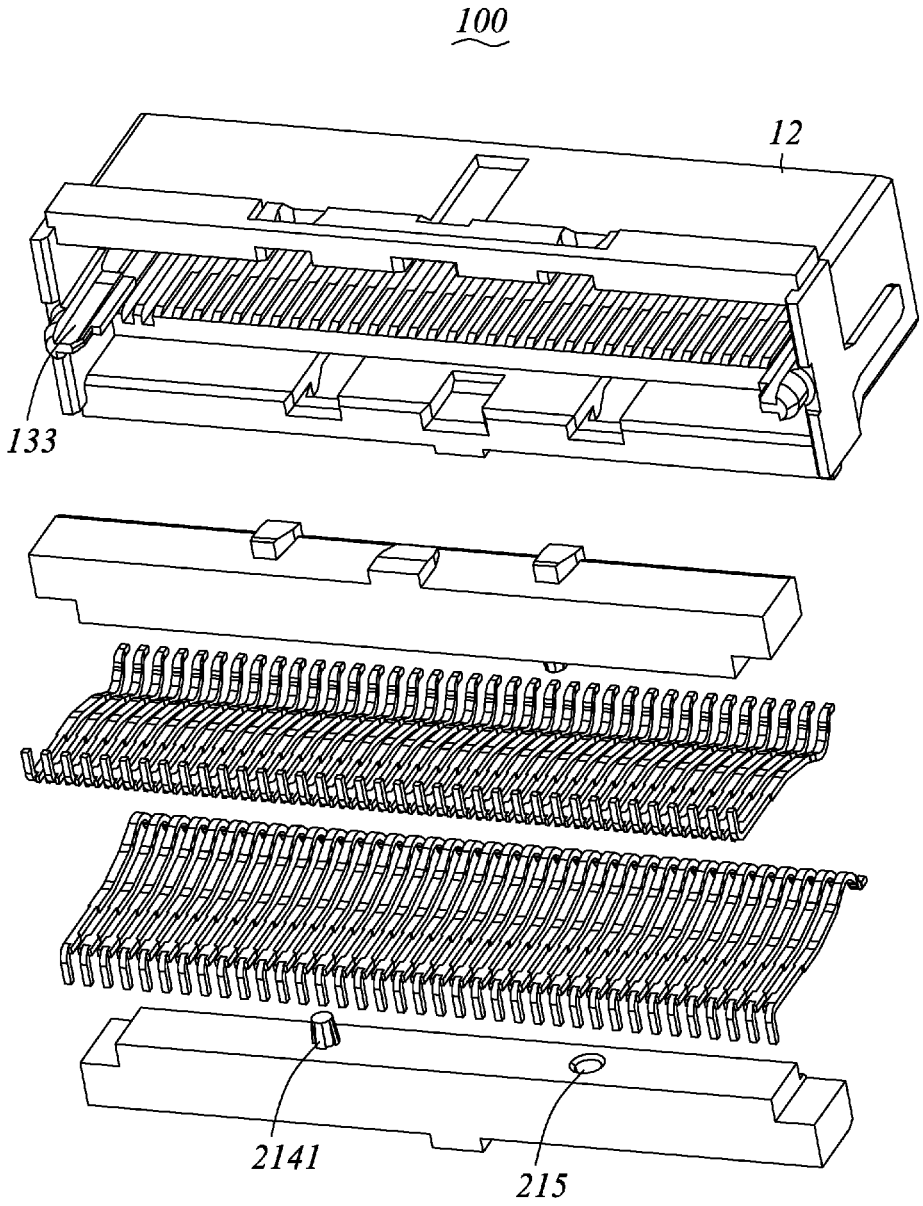
Figure 5:
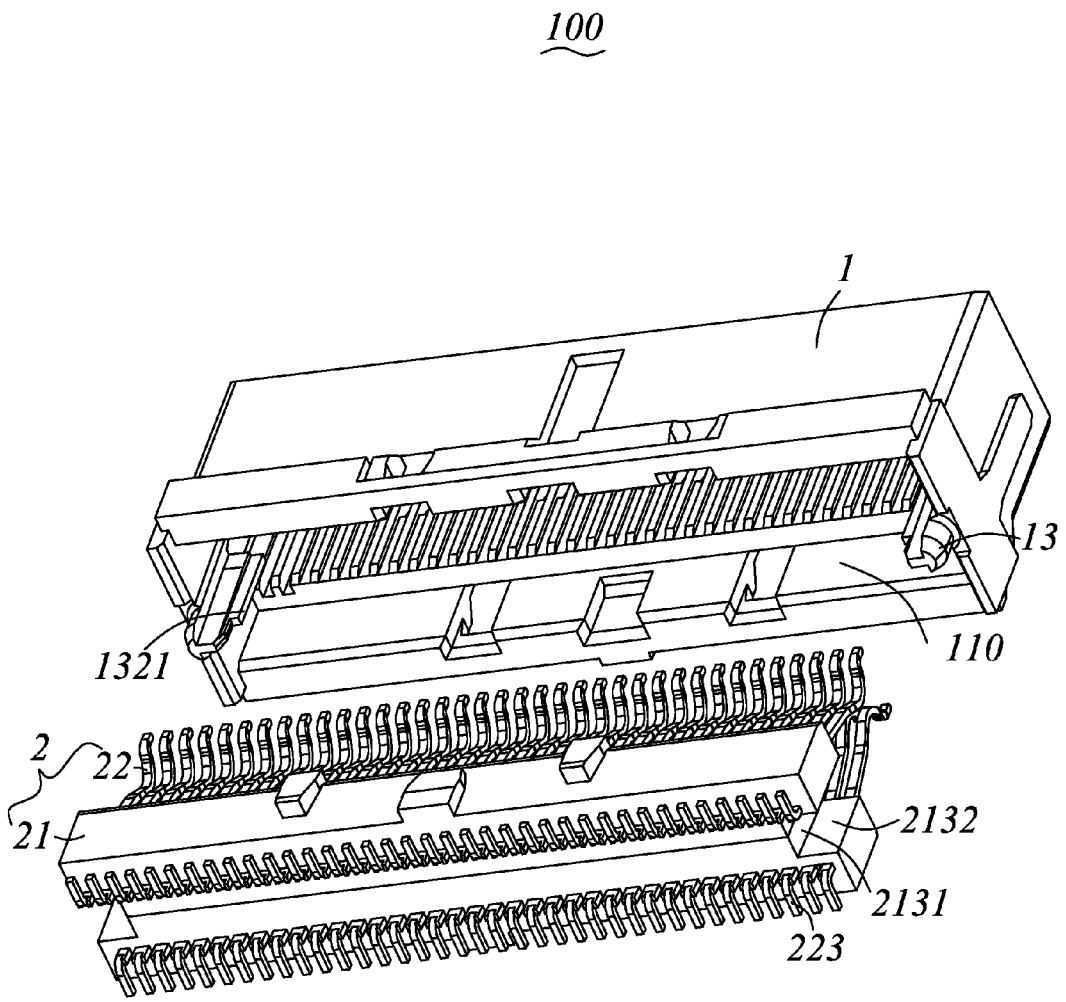
FIG. 5 is a partially assembled view of the electrical connector shown in FIG. 4.
Figure 6:
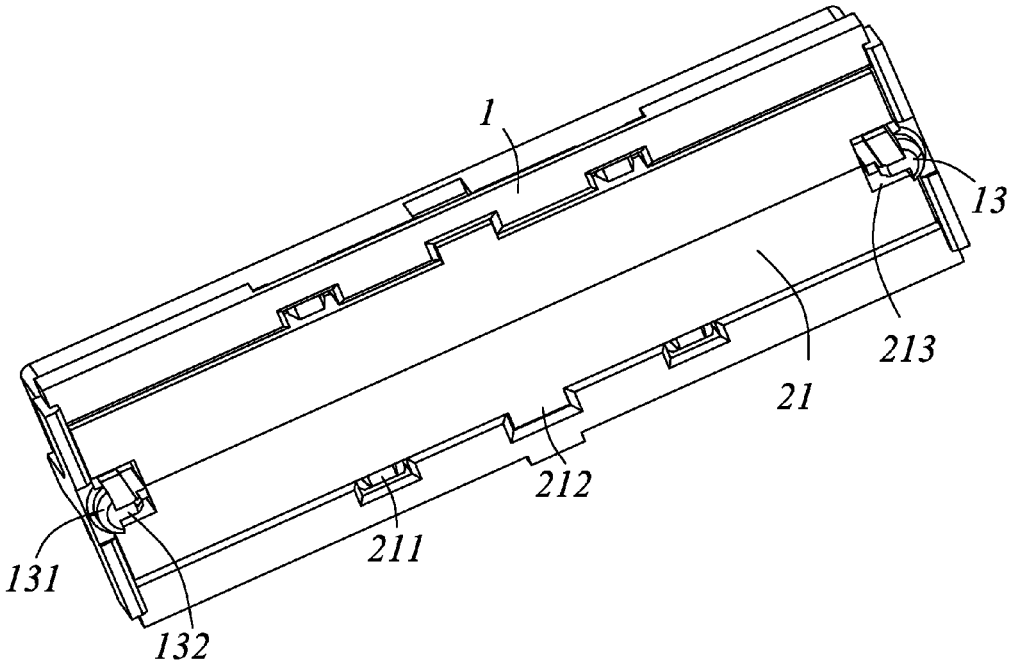
FIG. 6 is a perspective view of the electrical connector shown in FIG. 2, while removing contacts thereof.

Referring to FIGS. 3 to 5, the insulative housing 1 is elongated, and provided with a bottom mounting portion 11 and a mating portion 12 extending upwards from the mounting portion 11, and the mounting portion 11 has a larger width than the mating portion 12. A cavity 110 is formed in the mounting portion 11 and opens downwardly, and the mounting portion 11 has at least one latching slot 112 on each side wall thereof, and the latching slots 112 of the side walls are communicated with the cavity 110. The mounting portion 11 also defines a limiting slot 113 on each side wall thereof, and the limiting slots 113 are communicated with the cavity 110. In a preferred embodiment of the present invention, each limiting slot 113 is disposed in a middle position of mounting portion 11 along a lengthwise direction of the insulative housing 1, and each limiting slot 113 is defined between two latching slots 112 on both sides thereof along the lengthwise direction of the insulative housing 1.

The mating portion 12 has a central mating space 120 extending along the lengthwise direction and a pair of side walls 121 on both sides of the mating space 120. A plurality of contact receiving passageways 122 are defined on each side wall 121 and communicated with the cavity 110 along a height direction. The contact receiving passageways 122 on a same side wall 121 are arranged in a row along the lengthwise direction, and two rows of the contact receiving passageways 122 are opposite to each other along a direction perpendicular to the lengthwise direction.

The insulative housing 1 is further provided with a pair of locating portions 13 at two sides thereof, and the locating portions 13 extends downwards from the mounting portion 11, the distance between the pair of locating portions 13 is smaller than an internal diameter of the cavity 110 along the lengthwise direction. Each locating portion 13 is of T-shaped, and comprises a semicircular column 131 on the outside thereof and an extension portion 132 extending from the semicircular column 131 into the cavity 110, the semicircular column 131 has an outward arc surface and an inward plane. The extension portion 132 extends from the inward plane of the semicircular column 131 towards the interior of the cavity 110, and has an inner surface 1321 facing towards the opposite locating portion 13. In addition, a pair of demising slots 133 are formed on two sides of the extension portion 132 for the contact modules 2 passing through.

The two contact modules 2 are assembled into the insulative housing 1 from a lower side of the mounting portion 11 along a down-to-up direction, and each contact module 2 has an insulator 21 received in the cavity 110 and a plurality of contacts 22 insert-molded in the insulator 21. The insulator 21 defines a pair of bumps 211 locking with the latching slots 112 and a block 212 engaging with the limiting slot 113. The bumps 211 are close to an upper surface of the insulator 21, and the block 212 are defined near a lower surface of the insulator 21, thus to form a stagger relationship along an up-and-down direction.

Each insulator 21 has a pair of cutouts 213 on both ends thereof along the lengthwise direction, and the cutouts 213 are correspondingly arranged with the extension portions 132. A first upright surface 2131 perpendicular to the lengthwise direction and a second upright surface 2132 vertical to the first upright surface 2131 are connected with each other to form one cutout 213. The inner surface 1321 of the extension portion 132 is located outside of the corresponding first upright surface 2131. While the contact modules 2 assembled in the cavity 110, the cutouts 213 on both sides of the insulator 21 can prevent the contact modules 2 from being stopped by the extension portions 132.

One insulator 21 of the two contact modules 2 defines a protrusion 214 on the surface opposite to another insulator 21 matching with a positioning slot 215 on the another insulator 21. In the preferred embodiment of the present invention, each insulator 21 has one protrusion 214 projecting towards the opposite insulator 21 and one positioning slot 215 receiving the opposite protrusion 214 on the opposite insulator 21, and the protrusion 214 and the positioning slot 215 are spaced apart from each other with a certain distance. The protrusion 214 has a plurality of ribs 2141 extruding outwards, and the ribs 2141 are distributed evenly on the peripheral surface of projection 214, each rib 2141 has a gradually varied thickness along a radial direction of the protrusion 214. The positioning slot 215 has a gradually contracted configuration along a direction away from the corresponding insulator 21.

Figure 7:
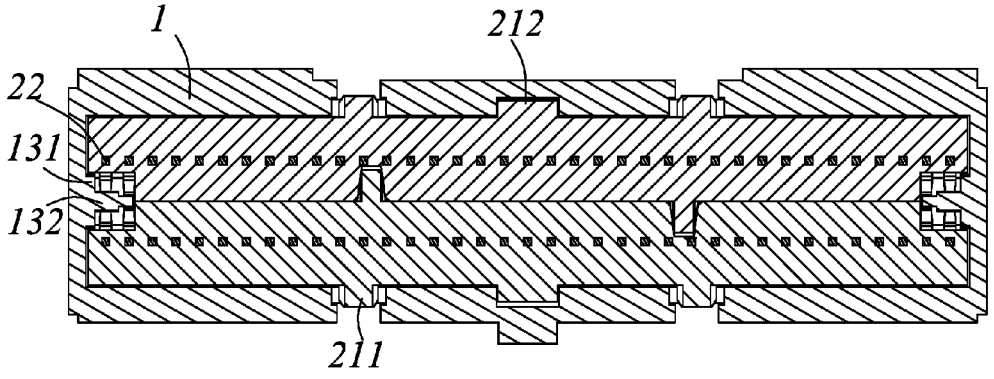
FIG. 7 is a cross-sectional view of the electrical connector taken along line 7-7 of FIG. 2.
Figure 8:
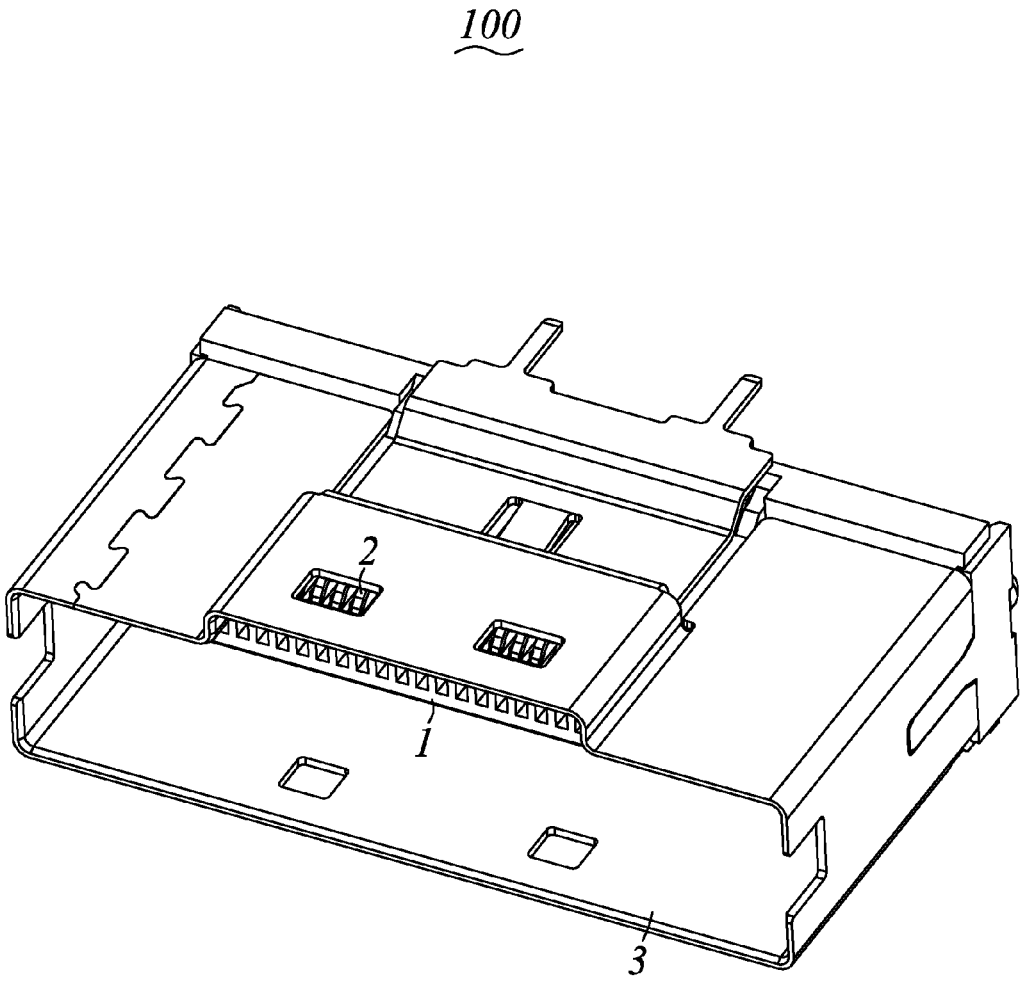
FIG. 8 is a perspective view of the electrical connector shown in FIG. 1, while assembling a shielding member on an insulative housing thereof.
Figure 9:
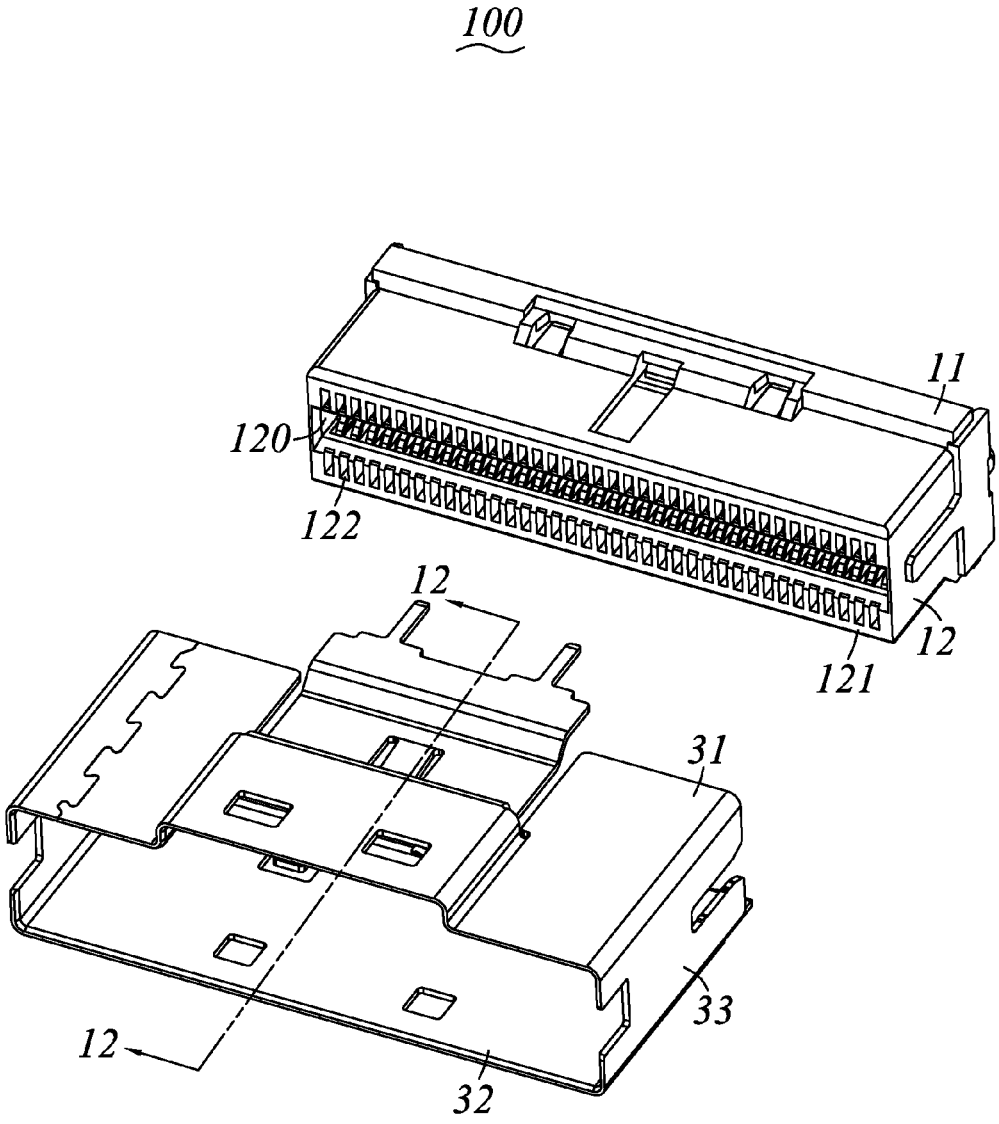
FIG. 9 is a partially exploded view of the electrical connector shown in FIG. 8.
Figure 10:
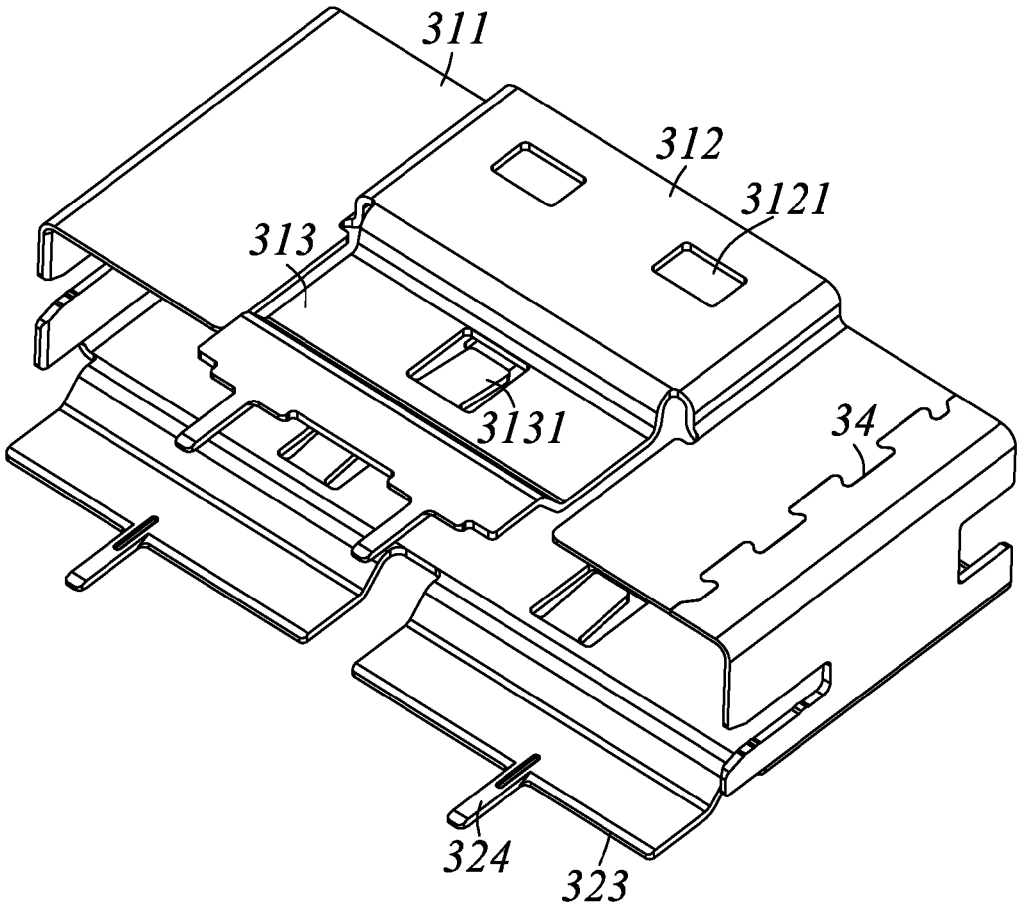
FIGS. 10-11 are perspective views of the shielding member of the electrical connector shown in FIG. 8.
Figure 11:
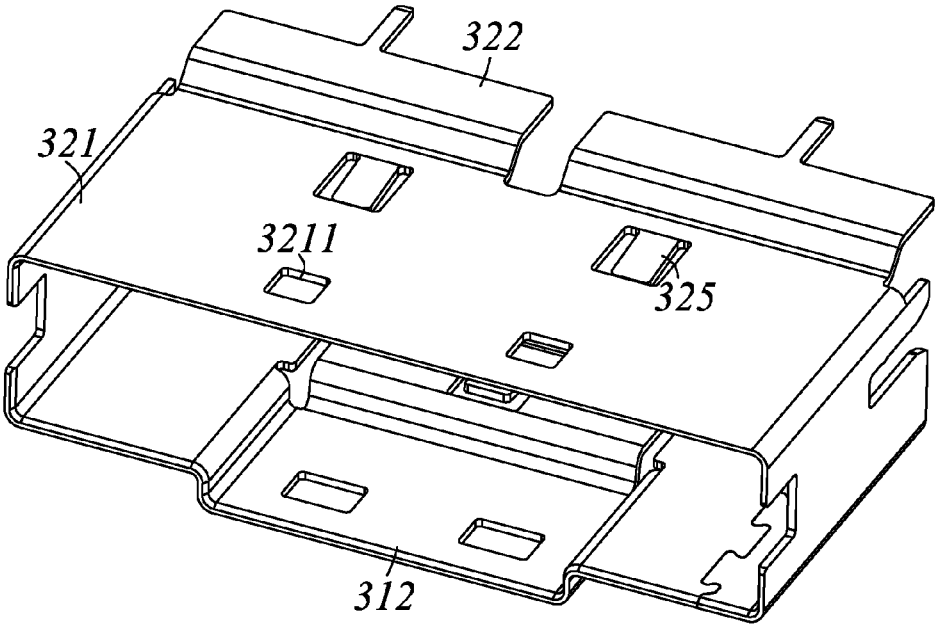
Figure 12:
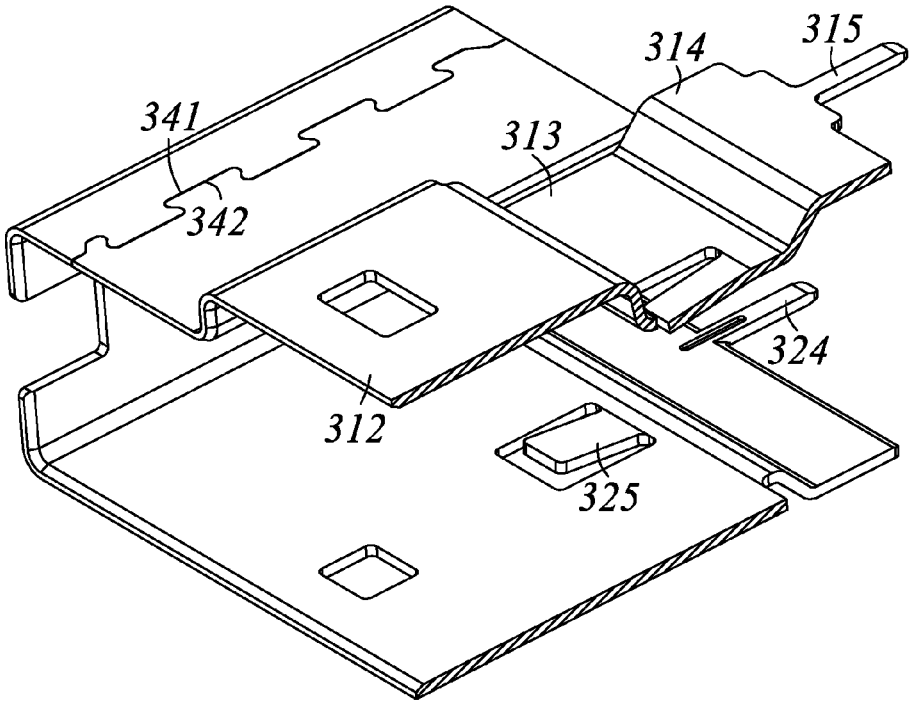
FIG. 12 is a cross-sectional view of the shielding member of the electrical connector shown in FIG. 9.

Referring to FIGS. 3-5, and conjunction with FIG. 7, the contacts 22 of the two contact modules 2 are arranged opposite to each other, and mirrored symmetry with each other along a vertical intermediate surface. Each contact 22 is provided with a contacting arm 221 projecting upwards into the relative contact receiving passageway 122 and a soldering portion 223 extending downwards, the soldering portion 223 is exposed out of the relative insulator 21, and the contacting arm 221 has a curved contacting portion 2210 exposed in the mating space 120 for mating with a complementary connector.

In assembly, the contacts 22 are insert-molded in the corresponding insulator 21 to form the contact module 2, the two contact modules 2 are assemble to each other, and the protrusion 214 of one insulator 21 is inserted into and matching with the positioning slot 215 of another insulator 21, until two opposite surfaces of the insulators 21 are intimately confronted with each other, therefore the two contact modules 2 are assembled together. Then the two contact modules 2 are assembled to the insulative housing 1 from the mounting portion 11 of the insulative housing 1 along a down-to-up direction, and the locating portions 13 are inserted into the corresponding cutouts 213 on two sides of the insulators 21, and exposed out of the lower surface of the insulator 21, the two insulators 21 are accommodated in the cavity 110. The bumps 211 and the blocks 212 on lateral sides of the contact modules 2 are matching with the latching slots 112 and the limiting slots 113 respectively, and the contacts 22 are inserted into the relative contact receiving passageways 122, thus the electrical connector 100 has a simple structure with a convenient insertion and assembling of contact modules 2.

Referring to FIGS. 8 to 12, the electrical connector 100 also has a shielding member 3 enclosing on the insulative housing 1. The shielding member 3 is formed by bending a metal sheet, and comprises a first lateral wall 31, a second lateral wall 32 and a pair of conjoining walls 33 connecting the two lateral walls 31, 32, and the first lateral wall 31 is opposite to the second lateral wall 32. The first lateral wall 31 has a pair of side portion 311 and an extrusion 312 located between the two side portions 311. One of the side portion 311 defines a joint 34 for shaping the shielding member 3 after bending forming. The joint 34 is a dovetail joint, and formed by a dovetail groove 341 latching with a dovetail portion 342. The first lateral wall 31 also has a middle section 313 below the extrusion 312, a lower section 314 under the middle section 313 and a pair of tail sections 315 extending downwards from a lower end of the lower section 314. The middle section 313 is bent from a lower end of the extrusion 312, and locating on a same plane with the two side portions 311, the lower section 314 is bent from a lower end of the middle section 313. A width between the extension 312 and the middle section 313 is larger than a width between the lower section 314 and the middle section 313.

The second lateral wall 32 comprises a main portion 321 parallel to the side portions 311 and a bottom segment 322 bent from a lower edge of the main portion 321. The second lateral wall 32 has a strip connecting portion 323 on a lower end of the bottom segment 322 for connecting with a strip (not shown) and a pair of soldering legs 324 extending downwards from the lower end of the bottom segment 322. The strip connecting portion 323 is defined outside of the soldering legs 324, the two tail sections 315 of the first lateral wall 31 is located between the two soldering legs 324 of the second lateral wall 32 along the lengthwise direction.

The extrusion 312 of the first lateral wall 31 has a pair of through holes 3121, and the second lateral wall 32 also has a pair of through holes 3211 in an area corresponding to the extrusion 312. The middle section 313 defines at least one resilient portion 3131 extending inwards to contact with the insulative housing 1 for a orientation therebetween, and the second lateral wall 32 also has at least one resilient portion 325 extending inwards to contact with the insulative housing 1. And in the preferred embodiment of present invention, the middle section 313 has a resilient portion 3131, and the second lateral wall 32 has a pair of resilient portion 325, the resilient portion 3131 of the middle section 313 is located between the pair of resilient portions 325 of the second lateral wall 32 along the lengthwise direction, and in middle of the two resilient portions 325. Upper ends of the resilient portions 3131, 325 are free ends, and extending towards the interior of the shielding member 3.

In present invention, the shielding member 3 of the electrical connector 100 has the extrusion 312 on one side thereof, and the joint 34 is defined on a same side of the shielding member 3 as the extrusion 312, and located on an outer side of the extrusion 312, thus the strip connecting portion 323 can be defined conveniently, and the extrusion 312 can be easy to be bent.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector, comprising:

an insulative housing being elongated, and provided with a bottom mounting portion and a mating portion extending upwards from the mounting portion, the mounting portion having a cavity opening downwardly, the mating portion having a central mating space extending along a lengthwise direction and a pair of side walls on both sides of the mating space, and a plurality of contact receiving passageways defined on each side wall and communicated with the cavity along a height direction; and two contact modules assembled into the insulative housing from a lower side of the mounting portion along a down-to-up direction, and each contact module having an insulator received in the cavity and a plurality of contacts insert-molded in the insulator, each contact defining a contacting arm projecting upwards into the relative contact receiving passageway and a soldering portion extending downwards to be exposed out of the relative insulator;

wherein the insulative housing defines a pair of locating portions extending downwards from two sides of the mounting portion, the distance between the pair of locating portions is smaller than an internal diameter of the cavity along the lengthwise direction, and a pair of demising slots are formed on an interior side of each locating portion for the contact modules passing through.

2. The electrical connector as claimed in claim 1, wherein each locating portion is of T-shaped, and comprises a semicircular column on the outside thereof and an extension portion extending from the semicircular column into the cavity, the pair of demising slots are formed on two sides of each extension portion.

3. The electrical connector as claimed in claim 2, wherein each insulator has a pair of cutouts on both ends thereof along the lengthwise direction corresponding to the extension portion.

4. The electrical connector as claimed in claim 3, wherein the semicircular column has an outward arc surface and an inward plane, and the extension portion extends from the inward plane of the semicircular column towards the interior of the cavity.

5. The electrical connector as claimed in claim 1, wherein one insulator defines a protrusion on the surface opposite to another insulator matching with a positioning slot on the another insulator.

6. The electrical connector as claimed in claim 5, wherein each insulator has one protrusion projecting towards the opposite insulator and one positioning slot receiving the opposite protrusion on the opposite insulator.

7. The electrical connector as claimed in claim 6, wherein the protrusion has a plurality of ribs extruding outwards, and the ribs are distributed evenly on the peripheral surface of projection, each rib has a gradually varied thickness along a radial direction of the protrusion.

8. The electrical connector as claimed in claim 1, wherein the mounting portion has a larger width than the mating portion, and the mounting portion has at least one latching slot communicated with the cavity, each insulator defines a bump locking with the latching slot.

9. The electrical connector as claimed in claim 1, wherein the mounting portion defines a limiting slot on each side wall thereof, and the limiting slots are communicated with the cavity, and each insulator defines a block engaging with the corresponding limiting slot.

10. The electrical connector as claimed in claim 9, wherein each limiting slot is disposed in a middle position of mounting portion along the lengthwise direction of the insulative housing, and each limiting slot is defined between two latching slots on both sides thereof along the lengthwise direction.

11. The electrical connector as claimed in claim 1, further comprising a shielding member enclosing on the insulative housing.

12. The electrical connector as claimed in claim 11, wherein the shielding member is formed by bending a metal sheet, and comprises a first lateral wall, a second lateral wall and a pair of conjoining walls connecting the two lateral walls, and the first lateral wall has a pair of side portion and an extrusion located between the two side portions, one of the side portion defines a joint for shaping the shielding member after bending forming.

13. The electrical connector as claimed in claim 12, wherein the joint is a dovetail joint, and formed by a dovetail groove latching with a dovetail portion.

14. The electrical connector as claimed in claim 12, wherein the second lateral wall has a strip connecting portion for connecting with a strip.

15. The electrical connector as claimed in claim 14, wherein the second lateral wall defines a pair of soldering legs extending downwards, and the strip connecting portion is defined outside of the soldering legs.

16. The electrical connector as claimed in claim 15, wherein the second lateral wall comprises a main portion parallel to the side portions and a bottom segment bent from a lower edge of the main portion, and the soldering legs extending downwards from the lower end of the bottom segment, the strip connecting portion is on a lower end of the bottom segment.

17. The electrical connector as claimed in claim 12, wherein the extrusion of the first lateral wall has a pair of through holes, and the second lateral wall also has a pair of through holes in an area corresponding to the extrusion.

18. The electrical connector as claimed in claim 12, wherein the first lateral wall also has a middle section below the extrusion, and the middle section is bent from a lower end of the extrusion, and locating on a same plane with the two side portions.

19. The electrical connector as claimed in claim 18, wherein the middle section defines at least one resilient portion extending inwards to contact with the insulative housing, and the second lateral wall also has at least one resilient portion extending inwards to contact with the insulative housing.

20. The electrical connector as claimed in claim 18, wherein the first lateral wall also has a lower section under the middle section and a pair of tail sections extending downwards from a lower end of the lower section.

* * * * *